United States Patent [19]

Johansson

[11] Patent Number: 4,878,798

[45] Date of Patent: Nov. 7, 1989

[54] BOX HANDLING APPARATUS

[75] Inventor: Lennart Johansson, Mjölby, Sweden

[73] Assignee: BT Industries AB, Mjolby, Sweden

[21] Appl. No.: 117,013

[22] Filed: Nov. 3, 1987

[30] Foreign Application Priority Data

Nov. 3, 1986 [SE] Sweden ..... 8604691

[51] Int. Cl.[4] ..... B66C 9/18

[52] U.S. Cl. ..... 414/280; 414/273; 414/661; 414/752; 901/46; 294/907

[58] Field of Search ..... 901/40, 46; 414/286, 414/277, 279, 280, 281, 282, 283, 661, 752, 659, 665, 663, 669, 670, 672, 331; 187/9 R, 9 E; 294/907, 64.1

[56] References Cited

U.S. PATENT DOCUMENTS

| | | | |
|---|---|---|---|
| 2,699,878 | 1/1955 | Avery | 414/661 X |
| 2,708,046 | 11/1952 | Cushman . | |
| 3,526,326 | 9/1970 | Castaldi | 414/273 |
| 3,610,672 | 10/1971 | Olson . | |
| 3,630,319 | 12/1971 | Peterson et al. | 414/661 X |
| 3,820,667 | 6/1974 | Critchlow et al. . | |
| 3,841,503 | 10/1974 | Hollenbach . | |
| 4,252,497 | 2/1981 | Burt . | |
| 4,358,239 | 11/1982 | Dechantsreiter | 414/661 |
| 4,492,504 | 1/1985 | Hainsworth . | |

FOREIGN PATENT DOCUMENTS

| | | |
|---|---|---|
| 2444534 | 4/1976 | Fed. Rep. of Germany . |
| 3111943 | 10/1982 | Fed. Rep. of Germany . |
| 3224974 | 1/1984 | Fed. Rep. of Germany . |
| 2133299 | 12/1972 | France . |
| 1397614 | 6/1975 | United Kingdom . |

*Primary Examiner*—Frank E. Werner

*Attorney, Agent, or Firm*—Frishauf, Holtz, Goodman & Woodward

[57] ABSTRACT

A handling apparatus for handling boxes stored in shelving compartments of storage shelving systems comprises a main body structure (11) which is adapted to be carried by a lifting device (12) and which is adjustable positionally thereby to a given level to be in registration with a respective shelf compartment (35). The body structure incorporates a plate-like support table (17) for supporting boxes (23), and a box dogging device (20) for dogging the boxes between the support table and respective shelf compartments. The box dogging device includes a vacuum device (21) which includes a plurality of suction cups (22) and which is movable along both the body structure and the support table. The dogging device and the support table are connected together so that the support table will move together with the dogging device during the initial and the final part of the movement of the dogging device. The suction cups engage an end or side wall of respective boxes, which boxes may be of various different shapes and sizes.

7 Claims, 2 Drawing Sheets

26
27
25
22
23
21
10
20
32
33
17
15
35
40
24
39
11
19
28
30
16
36
29
19
14
12

23
17
23
22
16
34
18
27
28
38'
38
31
15
21
20

BOX HANDLING APPARATUS

BACKGROUND OF THE INVENTION

The present invention relates to apparatus for handling boxes or crates intended for storage in the shelving compartments of storage shelving systems. The apparatus comprises a main body structure which is intended to be carried by a materials-handling vehicle and to be brought by means of a lifting device provided on the vehicle, to a position in which the box registers with a respective shelf compartment, and further comprises a box support table which is movable on the body structure, and a box dogging device which is arranged for movement along the body structure in a manner to move a box between the support table and said shelf compartment.

Several different kinds of such materials-handling devices are known to the art, and are used, inter alia, to handle automatically in large storage systems boxes which contain small component parts or like items. The boxes concerned are manufactured in accordance with particular requirements, including for instance the provision of hand-grips, and must fulfill high demands with regard to strength and robustness, so that the boxes can be handled repeatedly by mechanical devices without detriment to the boxes. These storage systems are well tested and relatively efficient, although they require the aforesaid component parts or like objects to be loaded into and unloaded from the aforesaid special-duty boxes. Because of the increased demand placed on the speed at which items can be handled in such storage systems and also because of the desire to hold the smallest possible quantity of items in store, the time taken to load and unload such boxes plays a significant part in the overall efficiency of the materials-handling cycle. One solution to this problem is to use, as far as is possible, one and the same box from the place of manufacture to the place where the items contained in the boxes are finally used. In this case, the boxes must, in the majority of instances, have the form of disposable boxes, intended for one time use only, and must be available in various sizes. This means that the boxes must be of simple and inexpensive manufacture. Suitable materials herefor are paperboard, plastics, etc. This means, in turn, that the boxes will not normally be self-supporting and that the boxes cannot be provided with handles or like gripping means, as in the case of the special-duty boxes.

Consequently, an object of the present invention is to provide a box-handling apparatus which is able to safely handle goods stored in boxes of various kinds, such as commercial, disposable packaging boxes. Other objects of the invention will become apparent from the following description.

SUMMARY OF THE INVENTION

These objects are achieved by means of an apparatus constructed in accordance with the invention and having the characteristic features set forth in the following claims. Thus, the box handling apparatus according to the invention enables non-rigid paperboard boxes to be handled reliably, in both small storage systems and large, automatic storage complexes. This is made possible by supporting the box on a planar solid support surface and holding the box firmly with the aid of suction devices located at one end of the support surface, such that only one side of the box is engaged. Because the box is only engaged on one side thereof, it is possible to use the apparatus with boxes of varying width, depth and height, and also to allow the upper side of the box to be left open. The suction device is flexible and is gentle with the box material, and includes a plurality of suction cups, of which only those cups which engage the side of the box concerned are activated. This enables the total suction force generated to be readily adapted to the size of the box and to the strength of the material from which the box is made. The suction boxes selected are preferably activated automatically with the aid of sensors which sense the surface area of the side of the box concerned, and a main computer system may be programmed to activate selected suction cups and to adjust said cups on the basis of information fed to the computer concerning the size etc. of the relevant side of said box. By enabling the support table, or support surface, to move relative to the main body of the apparatus, the table can be caused to bridge the gap formed, at each time, between the main body of the apparatus and respective shelf compartments. This enables boxes of varying depths to be fully supported upto the shelf compartment. This movement of the support table or support surface, is readily accomplished by connecting the box dogging device to the support table through a slot provided therein.

The support table is preferably arranged in a manner which will enable it to be swung horizontally through an angle of $\pm 90°$ in relation to the carrying vehicle, thereby enabling goods to be collected and delivered rapidly in three mutually independent directions with the minimum of movement. This means that the box need only be marked on the box-wall exposed to the box handling apparatus, which in turn reduces the risk of double marking or wrong marking.

BRIEF DESCRIPTION OF THE DRAWINGS

The invention will now be described in more detail with reference to the accompanying drawings, in which.

DETAILED DESCRIPTION

Figure 3:
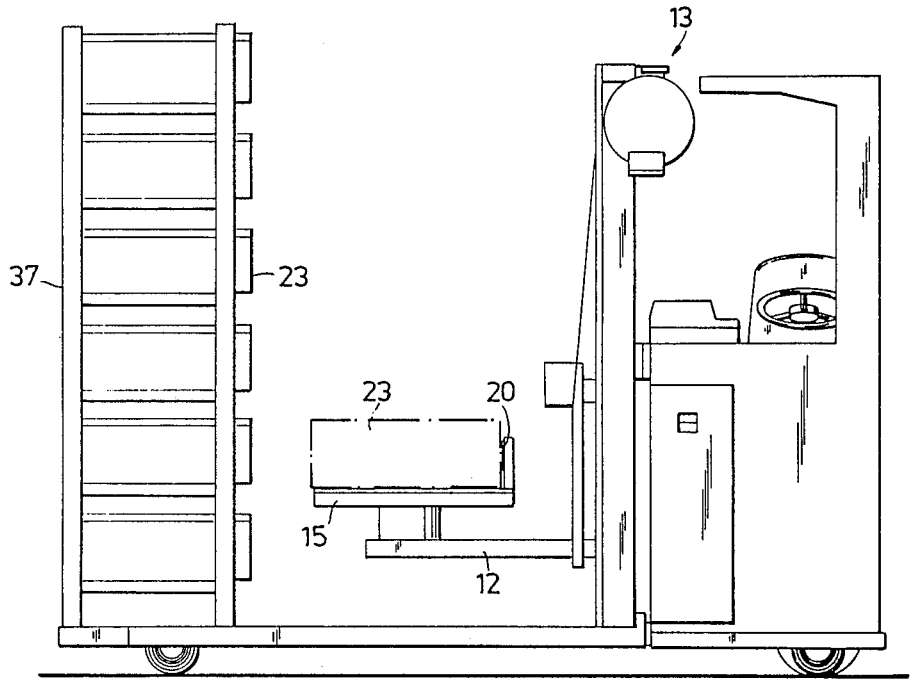
FIG. 3 is a side view of a materials handling vehicle equipped with the box handling apparatus illustrated in FIGS. 1 and 2.

The illustrated box handling apparatus includes a main body structure, generally referenced 11, which is intended to be carried by a lifting device 12 provided on some suitable materials-handling vehicle, generally referenced 13 in FIG. 3. The body structure 11 incorporates a gear housing 14 and a frame 15 which is mounted for horizontal pivotal movement about a vertical axis 10. The pivotal or swinging movement of the frame 15 is effected in some suitable manner with the aid of an electric motor 16 housed in the gear housing. A flat, plate-like support table 17 is carried on two rails 18 in the frame 15. The support table 17 rests on two wheels or runners 19 which are arranged to run in a respective rail 18, and is moved along the rails with the aid of a box-dogging or box-driving device 20. The dogging device 20 includes a carrier 21 which carries a plurality of suction cups 22 which are operative in holding boxes or crates 23 in firm contact with the dogging device 20.

The subpressures necessary herefor are generated with the aid of a vacuum pump 24, which is connected to the carrier 21 via a vacuum reservoir 25, a three-way valve 26 and a suction hose 27. Forward propulsion of the dogging device 20 is effected with the aid of a ball-bearing screw or spindle, the screw axle of which is journalled in the frame 15 and is rotated by means of an electric motor 29 equipped with a slipping clutch 30. The box dogging or box driving device 20 is provided with a screw-threaded device or nut 29 which corresponds to the screw thread of the screw 28 and protrudes through an elongated slot 31 provided in the support table 17, via an angle iron 40. The box dogging device is conveniently equipped with wheels 32 which are intended to run along an upper, flat slide surface 33 incorporated on the support table 17, so as to hold the dogging device in its intended position at right angles to the screw axle 28. The linear extension of the slot 31 is shorter than the length of the full working stroke of the dogging device, which means that when approaching either of the two terminal positions of the screw axle, the box dogging device will be moved forwards to a respective end surface 38, 38' of the slot and will therewith also move the support table 17. The carrier 21 has mounted thereon sensors 24 for establishing the size of one side of a box or crate 23 carried on the support table, and for initiating activation of those suction cups 22 which are intended to engage said side of the box, the number of suction cups activated being contingent on the established measurement of size of said box-side.

When the box handling apparatus is to be used for collecting a box from a storage shelf 35, the body structure 11 is first brought to a suitable level, by means of the lifting device 12. The frame is then rotated horizontally to a suitable box-collecting position, with the aid of the rotational motor 16. The frame 15 can be rotated through ±90° to any one of three box collecting positions. Subsequent to positioning the frame, the ball-bearing screw is activated, so as to advance the dogging device 20 to the edge 38 of the support table 17, which table then moves together with the dogging device and bridges the gap 36 between the frame 15 and the storage shelf. In the simplest case, this movement can continue until the support table strikes the shelf and results in the release of the slipping clutch 30. In other cases, various sensors can be used to interrupt this movement of the support table at an earlier stage. When the suction cups 32 reach the location of the box 35, the sensors 34 sense the size of the box and on the basis thereof activate the correct number of suction cups required to hold the box, the suction force generated by the suction cups preferably being adapted so that those suction cups which are located nearest the corners of the box exert the greatest suction force. this facility may also be incorporated in the master program of a computer used to control the apparatus. Subsequent to activating the suction cups, by changing the setting of the valve 26, it is possible to commence withdrawal of the box from the shelf. This is effected by rotating the ball-bearing screw 28 in the opposite direction, whereupon the box dogging device will draw the box onto the support table. Since the friction between the box and the slide surface 33 on said table is normally greater than the rolling friction between the support table and the rails 18, the support table will accompany said movement until the support table is stopped mechanically, suitably by means of a mechanical stop device provided herefor. The box dogging device, however, continues to move along the slot, therewith drawing the box forwards to a suitable terminal position, with the aid of the activated suction cups.

When the box 35, subsequent to being moved away by means of the vehicle 13, and optionally stepped rotationally around the gear housing 14, is to be moved out and deposited on a further storage shelf or placed on some other storage site, the friction acting between the box and the slide surface 33 is greater than the friction acting between the support table 17 and the frame 15, similar to the earlier described case. Thus, the box dogging device will first move the support table, together with the box, out towards the surface on which the box is to be placed, and the box will not move relative to the slide surface until movement of the support table is blocked. When the box has reached its intended terminal position, the setting of the valve 26 is changed, so as to move the suction forces acting on the box and to return the box dogging device to its withdrawn, starting position. During the latter part of this withdrawal movement, the box dogging device forcibly returns the support table, so that no part of the support table will protrude from the frame 15 in a manner to present an obstruction to the free passage of the vehicle or to the rotational stepping or indexing of the frame 15.

The concept of an apparatus construction which includes a drive motor 29 which is common to both the box dogging device 20 and the support table 17 results in lower apparatus costs and also in a relatively low total construction height, which is highly beneficial in the present context. Furthermore, because the box or crate 35 is always held firmly by the activated suction cups while the frame 15 is indexed or stepped around the vertical axis 10, or moved in some other way, no side guides or side supports are required for securing the box against horizontal movement during such indexing or rotational movement of the frame. The provision of such guards would render it difficult to handle boxes of varying sizes. In order to generate appropriate movement characteristics, both the linear motor and the rotory motor are d.c. motors. These motors are conveniently controlled by control devices which will ensure a gentle start, which will provide adapted top speeds, and which, via sensors, provide a retardation force which will enable the support table, frame, etc., to be driven linearly and rotationally into contact with mechanical stop means with a high degree of positional accuracy.

Figure 1:
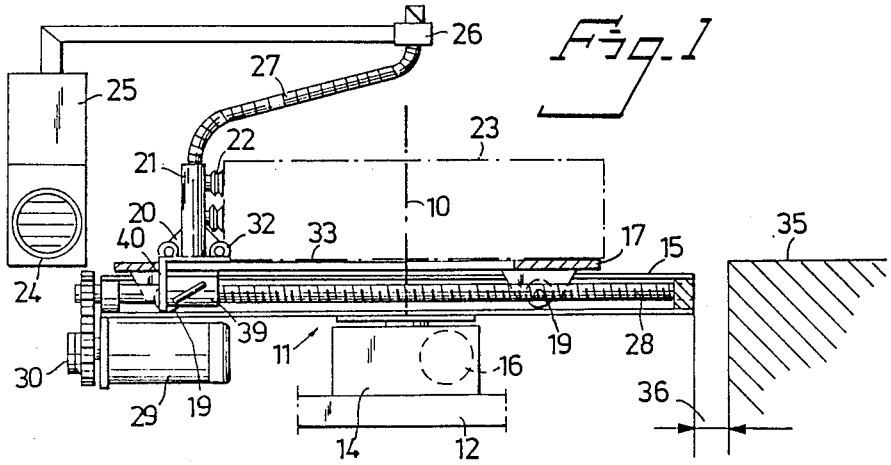
FIG. 1 is a side view, partly in section, of a box handling apparatus constructed in accordance with the invention.
Figure 2:
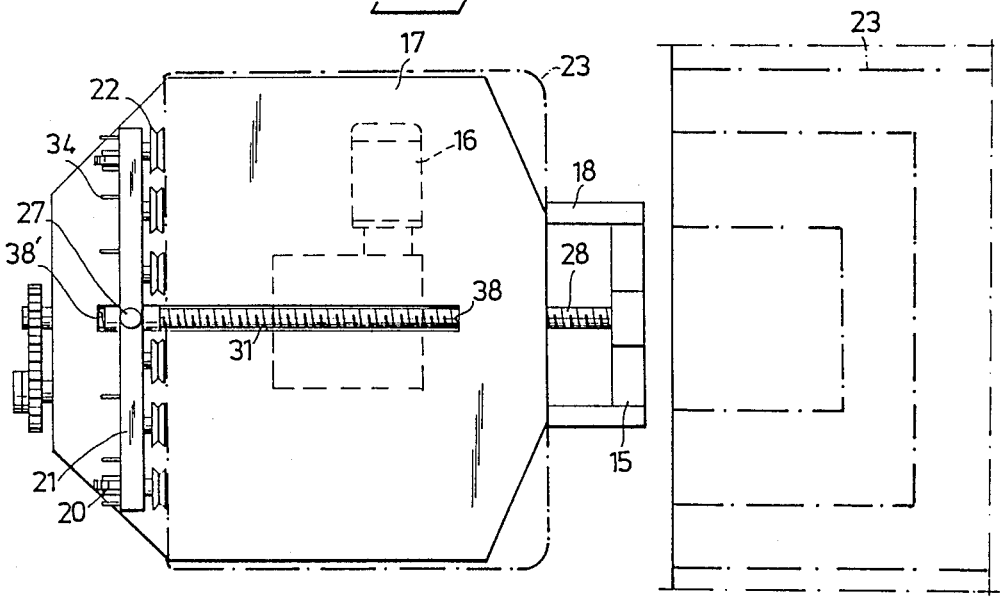
FIG. 2 is a view of the apparatus illustrated in FIG. 1 from above.

One example of how the handling apparatus illustrated in FIG. 1 can be used will now be described with reference to FIG. 3. FIG. 3 shows the box handling apparatus raised to a given level by the lifting device 12 of a materials-handling truck 13, which also carries a box-rack 37 which contains a plurality of shelf compartments. These shelf compartments are filled progressively with boxes or crates taken from storage shelves located on one or both sides of the truck. Thus, the handling apparatus must be turned through ±90° subsequent to collecting a box from a respective storage shelf. Subsequent to collecting a given number of boxes, the truck is driven to a treatment station, where the boxes are either off-loaded one at a time or the whole box-rack 37 is removed from the vehicle. As beforementioned, the treatment station may be some suitable kind of production machine for treating or processing the objects removed from the boxes. One and the same vehicle may also be equipped with a plurality of handling apparatus constructed in accordance with the invention, therewith obviating the need for the additional box-rack 37. It will be understood that the invention is not restricted to the described and illustrated exemplifying embodiment thereof, and that modifications can be made to the illustrated embodiment within the scope of the following claims. For example, the box handling apparatus may be mounted on a simple, manually operated pallet-trolley and may also be controlled purely manually.

I claim:

1. Apparatus for handling boxes stored in shelf compartments of a storage shelving system, comprising:

a body structure adapted to be carried by a materials-handling vehicle, said body structure being movable to a given vertical level by a lifting means provided on said vehicle, so as to be in registration with a respective shelf compartment of the storage shelving system;

a box support table on said body structure and being movable along said body structure by means of a box dogging device;

said box dogging device being arranged for dogging movement along said body structure with a drive means for dogging respective boxes between said box support table and said respective shelf compartment;

said box dogging device including a plurality of suction cups commonly mounted on a carrier device which is mounted on said box dogging device, and vacuum means coupled to said suction cups, said suction cups being arranged for engagement with a side of a box when said vacuum means is activated;

guiding means provided on said body structure and on which said box support table is movable between an inner and outer terminal position;

said box support table comprising a substantially flat supporting plate having a substantially flat slide surface on which boxes are displaceable by means of said box dogging device, said substantially flat plate having an elongated opening therein;

said box dogging device with said carrier device extending through said elongated opening in said substantially flat plate, the linear extension of said elongated opening being shorter than the length of a full working stroke of said box dogging device so that said box dogging device by engaging a respective end surface of said elongated opening prior to the box support table reaching its respective terminal position also moves said substantially flat plate therewith.

2. The apparatus of claim 1, wherein said elongated opening is an elongated slot provided substantially centrally in said substantially flat plate.

3. The apparatus of claim 2, wherein said elongated slot has a linear dimension such that said box dogging device engaged a respective end surface of said elongated slot prior to said box dogging device terminating movement of said box.

4. The apparatus of claim 1, comprising a screw means for driving said box dogging device; and wherein said drive means comprises a rotatable, motor driven screw axle for propulsion of said box dogging device.

5. The apparatus of claim 1, wherein:

said body structure comprises a frame which is rotatable horizontally through an angle of $\pm 90°$ in relation to said vehicle; and said box support table is guided on rails provided in said frame.

6. The apparatus of claim 1, wherein said carrier device for said suction cups comprises:

sensor means for determining a size of a side of a box approaching said suction cups; and means for applying vacuum from said vacuum means only to those suction cups which are located so as to co-act with said side of said approaching box, thereby activating the suction cups to which vacuum is applied.

7. The apparatus of claim 6, comprising means for varying a suction force generated in respective suction cups, such that the suction cups located nearest corners of said side of said approaching box generate suction force greater than the suction force of the other of the activated suction cups.

* * * * *